US005724780A

United States Patent [19]

Bolich

[11] Patent Number: 5,724,780

[45] Date of Patent: Mar. 10, 1998

[54] METAL BUILDING ROOF STRUCTURE

[75] Inventor: Richard M. Bolich, Toledo, Ohio

[73] Assignee: Owens-Corning Fiberglas Technology, Inc., Summit, Ill.

[21] Appl. No.: 478,130

[22] Filed: Jun. 7, 1995

[51] Int. Cl.[6] ..... E04B 1/74

[52] U.S. Cl. ..... 52/407.4; 52/407.1; 52/407.3; 52/461

[58] Field of Search ..... 52/222, 404.3, 52/406.1, 406.3, 407.1, 407.2, 407.3, 407.4, 408, 506.07, 461

[56] References Cited

U.S. PATENT DOCUMENTS

| | | | |
|---|---|---|---|
| 3,619,437 | 11/1971 | McDonald, Jr. | 52/407.4 X |
| 3,969,863 | 7/1976 | Alderman . | |
| 4,075,806 | 2/1978 | Alderman | 52/90.1 |
| 4,117,641 | 10/1978 | Wells | 52/404.3 |
| 4,135,342 | 1/1979 | Cotter | 52/406.1 X |
| 4,375,741 | 3/1983 | Paliwoda | 52/404.3 X |
| 4,434,601 | 3/1984 | Zellmer | 52/407.1 X |
| 4,446,665 | 5/1984 | Berger . | |
| 4,472,920 | 9/1984 | Simpson | 52/404.3 X |
| 4,566,239 | 1/1986 | Smigel et al. | 52/407.4 |
| 4,590,727 | 5/1986 | Ghahremani et al. | 52/222 X |
| 4,738,072 | 4/1988 | Clemensen et al. . | |
| 5,442,890 | 8/1995 | Fligg | 52/404.3 X |

FOREIGN PATENT DOCUMENTS

| | | | |
|---|---|---|---|
| 2315793 | 10/1974 | Germany | 52/407.4 |

*Primary Examiner*—Carl D. Friedman
*Assistant Examiner*—Kevin D. Wilkens
*Attorney, Agent, or Firm*—C. Michael Gegenheimer; Curtis B. Brueske

[57] ABSTRACT

A metal building roof structure includes a plurality of purlins in a parallel arrangement in which the purlins have a generally vertical leg and a generally horizontal top leg. An insulation support sheet depends from the horizontal legs of adjacent purlins, and a purlin cap, having a horizontal top portion, is positioned on top of the horizontal top leg of the purlin. The purlin cap also has two generally vertical portions extending downwardly from the horizontal top portion and is placed over the insulation support sheet so that the two vertical portions of the purlin cap cause the insulation support sheet to substantially conform to the shape of the vertical leg of the purlin, thereby defining an insulation area having deep corners to enable the full thickness of the insulation material to be used.

12 Claims, 5 Drawing Sheets

METAL BUILDING ROOF STRUCTURE

TECHNICAL FIELD

This invention relates to the attachment and support of insulation material to a metal roof structure for use in commercial and industrial buildings.

BACKGROUND

The metal roof structures typically comprise a series of parallel rafter beams extending across the building in one direction and purlins parallel to each other mounted on top of the rafters extending in a direction normal to the rafters. Insulation material in long sheets arc then placed between the purlins. The sheets of insulation arc stretched to prevent sagging between the purlins, and the hard roofing material is attached over the insulation material and onto the purlins. The stretching of the insulation material can be dangerous for the workers on top of the previously laid hard roofing material and often poor alignment results. The poor alignment can cause gaps of insulation material and create a thermal short circuit. Therefore, supporting the insulation material is desirable both for safety reasons and to eliminate the formation of gaps.

Various methods have been used to support the insulation material and these include mounting support straps, wire or wire mesh to adjacent purlins to form a lattice. A sheet, typically made of vinyl and acting as a vapor barrier, is then rolled onto the lattice, and insulation material is placed between the adjacent purlins and over the sheet. The installation of the lattice must be done from underneath the roof structure which requires scaffolding or lifting equipment. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is draped from the adjacent purlins and creates an insulating area directly above the support sheet in which the insulation material is placed. However, the support sheet sags between the purlins and results in a small vertical height at the sides adjacent to the purlins. When the insulation material is placed onto the support sheet and the hard roofing material is mounted upon the purlins, the result is a compression of the insulation material at the edges of the insulating area and a loss of thermal value.

An additional step when draping the insulation material is to use clips to hold the support sheet onto a bottom portion of the purlin. The clips are fastened to the bottom of the purlin and must be installed from underneath the roof structure. Although the insulating area is increased at the sides, the installation cost is increased because of the need for the workers to work on scaffolding or lifting equipment.

It would be desirable to have a system of building a metal roof structure that is inexpensive and simple to construct and provides for an insulation support system which enables the full thickness of the insulation blanket to be used.

DISCLOSURE OF INVENTION

There has now been invented an improved method of attaching and supporting insulation material to a metal roof structure in which a support sheet is draped over adjacent purlins and a purlin cap is used to provide for a large insulating area, which enables the full thickness of the insulation material to be used. This system greatly improves the thermal value of the roof structure while not requiring the use of a lattice structure. The system of the invention eliminates the need to install any portion from underneath the roof structure.

The present invention comprises a metal building roof structure having a series of parallel rafter beams extending across the building in one direction and purlins parallel to each other mounted on top of the rafters extending in a direction normal to the rafters. The purlins have a generally vertical leg and a generally horizontal top leg. An insulation support sheet depends from the horizontal legs of adjacent purlins. The adjacent purlins and the support sheet define an insulating area in which insulation material is placed. A purlin cap is positioned on top of the purlin and is used to hold down the support sheet. The purlin cap has a horizontal top portion and two generally vertical portions extending downwardly from the horizontal top portion. The purlin cap is positioned on top of the horizontal top leg of the purlin and over the insulation support sheet so that the two vertical portions of the purlin cap cause the insulation support sheet to substantially conform to the shape of the vertical leg of the purlin.

In a specific embodiment of the invention, the insulating area has a corner located adjacent to the purlin at a location where the purlin vertical leg and the purlin bottom leg intersect. This corner maximizes the height of the insulating area adjacent to the purlin to provide for a larger insulating area between the adjacent purlins. An insulation strip, such as a foam board, can be applied to the purlin cap by an attachment structure formed on the horizontal top portion of the top of the purlin cap. In another embodiment of the invention, a trim strip having opposing tabs may be mounted on either a shoulder of the purlin cap or on the horizontal bottom leg of the purlin. The trim strip provides for an aesthetically pleasing appearance of the underside of the roof structure.

There is also provided a method for insulating a metal building roof structure including positioning an insulation support sheet so that it depends from the horizontal top legs of adjacent purlins. The purlin cap of the invention is applied on top of the purlin causing the support sheet to substantially conform to the shape of the vertical leg of the purlin. The insulation strip can then be applied on top of the purlin cap to provide for further insulation. The trim strip may also be mounted upon either a shoulder of the purlin cap or on the horizontal bottom leg of the purlin.

BEST MODE FOR CARRYING OUT THE INVENTION

Figure 1:
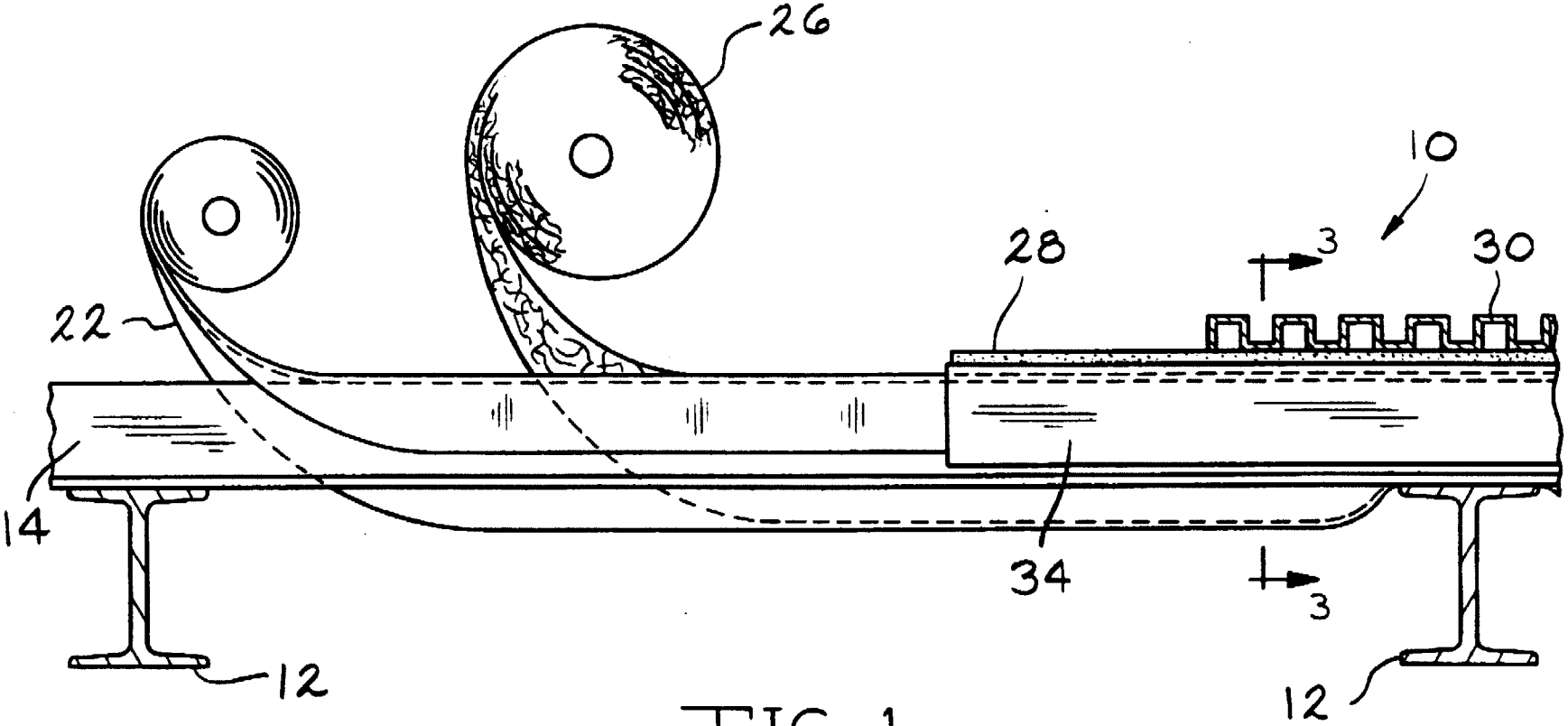
FIG. 1 is a side elevational view showing the method of assembling a metal building roof structure of the present invention.
Figure 2:
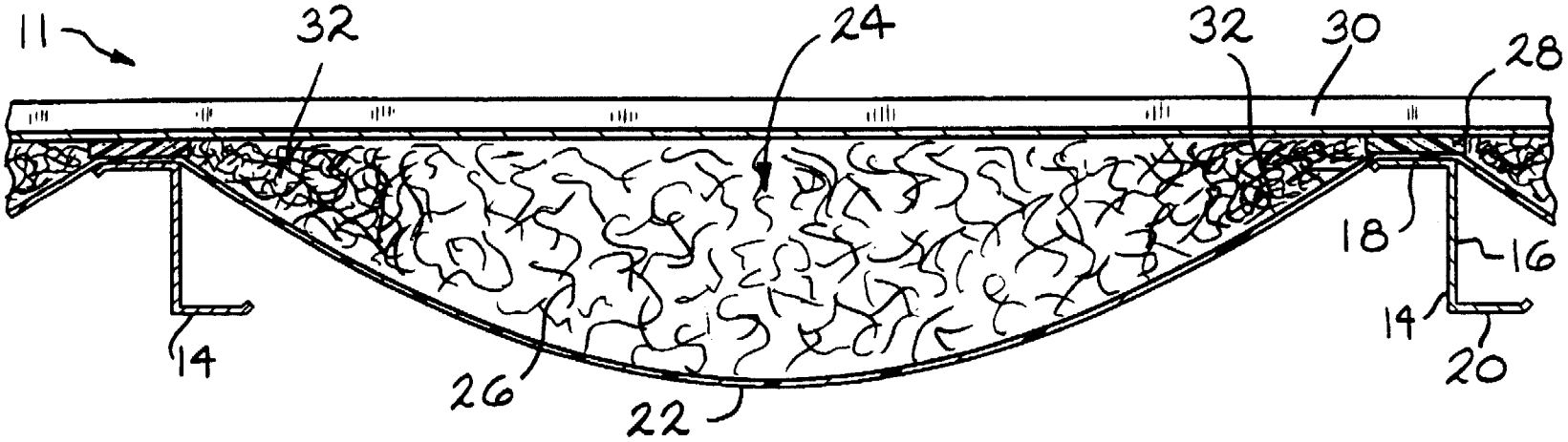
FIG. 2 (PRIOR ART)
FIG. 2 is a cross-sectional view of a prior art roof structure.
Figure 3:
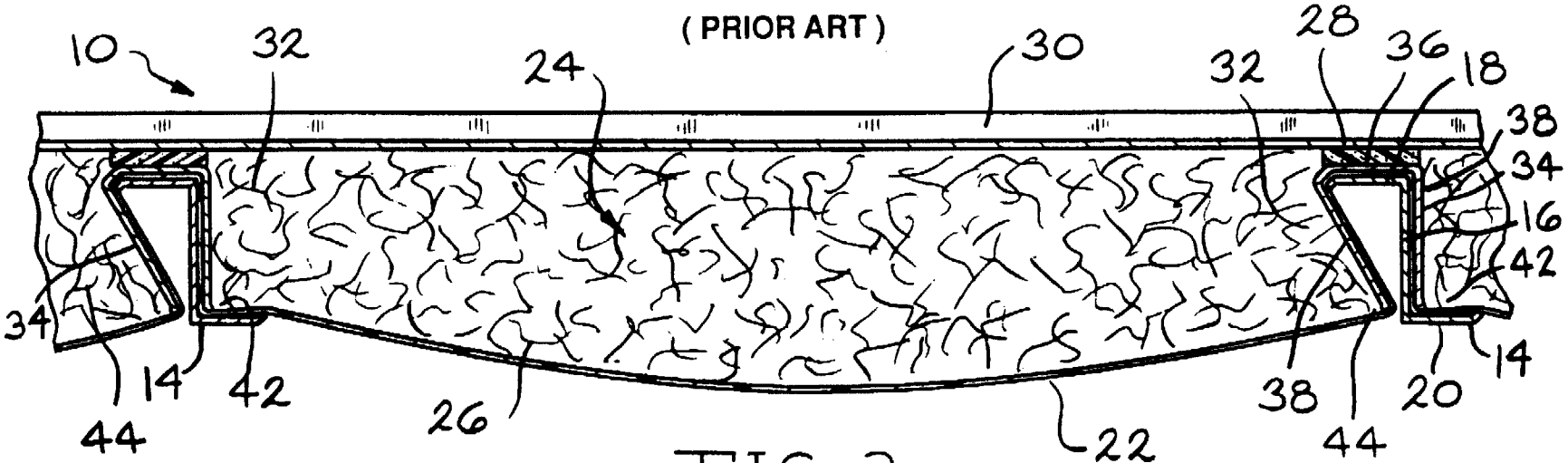
FIG. 3 is a cross-sectional view of the roof structure of the present invention taken along lines 3—3 of FIG. 1.

Them is illustrated in FIG. 1 a metal building roof structure of the present invention generally indicated at 10. The prior art roof structure 11 of FIG. 2 is constructed in much the same way. The roof structures 10 and 11 are typically supported by main rarer beams 12 which are positioned parallel to each other. A plurality of purlins, spaced generally parallel to each other, are fastened on top of the rafters 12 in a direction normal to the rafters 12. The spacing of the purlins is typically 6 feet on centers. The purlins 14 and rafters 12 are made from construction grade steel and encompass the entire roof structure 10. The roof structures 10 and 11 can be arranged in a sloped pattern forming a peak for an inclined roof. As can be seen in FIGS. 2 and 3, the purlins have a generally Z-shaped cross-section. Purlins have various shapes and typically they have a vertical leg and one or more horizontal legs. As shown, the purlins 14 have a vertical leg 16, a horizontal top leg 18 and a horizontal bottom leg 20. The horizontal bottom leg 20 is fastened to the top of the rafters 12.

As shown in FIGS. 1–3, to construct the roof structures 10 and 11, an insulation support sheet 22 is draped over the horizontal top legs 18 of two adjacent purlins 14 and rolled in the direction of the extending purlins 14. The purpose of the support sheet is to support the insulation material, but the support sheet can also be used as a vapor barrier or for aesthetic purposes. The support sheet can be of any material suitable for the purposes, such as vinyl. The width of the support sheet 22 is generally such that its sides slightly overhang the adjacent purlins 14. The support sheet is loosely positioned such that it sags and extends lower than the horizontal top leg 18 of the purlins 14. The support sheet 22 and the adjacent purlins 14 define an insulating area 24 into which an insulation material 26 is placed. The insulation material 26 is preferably made of a fiberglass material but can be composed of other insulation material such as rock-wool or foam. The support sheet 22 and insulation material 26 can be applied from rolls, as shown in FIG. 1, which are attached to a carriage assembly (not shown) for ease of installation. The insulation material 26 may also be adhered to the support sheet prior to assembly of the roof structure 10 with the support sheet 22 being wider than the insulation material 26 so that the sides of the support sheet can be draped over the purlins 14.

An insulation strip 28 is preferably placed on top of the support sheet directly above the top leg 18 of the purlin 14. The insulation strip 28 can be made of any number of insulating materials, such as rigid foam. The insulation strip 28 provides protection from a thermal short circuit through the purlins because there is no insulation material on top of the purlin top leg. A section of a hard roofing material is then placed on the insulation strip and fastened to the purlins. The hard roofing material 30 is typically formed from corrugated steel and serves as a platform for the workers to stand on to construct the next section of the roofing structure. The disadvantage of the prior art roofing structure 11, shown in FIG. 2, is that attaching the hard roofing material 30 to the purlins 14 causes the insulation material 26 to compress at sides 32 of the insulating area 24. This compression reduces the insulating area 24 and lowers the overall thermal value. The resulting loss of thermal value effectively reduces the R value of the roof. For example, an R 38 insulation material when compressed at the sides 32 might result in an overall insulation system value of R 23. This decrease significantly lowers the efficiency of the insulated roof structure making it costly.

Figure 4:
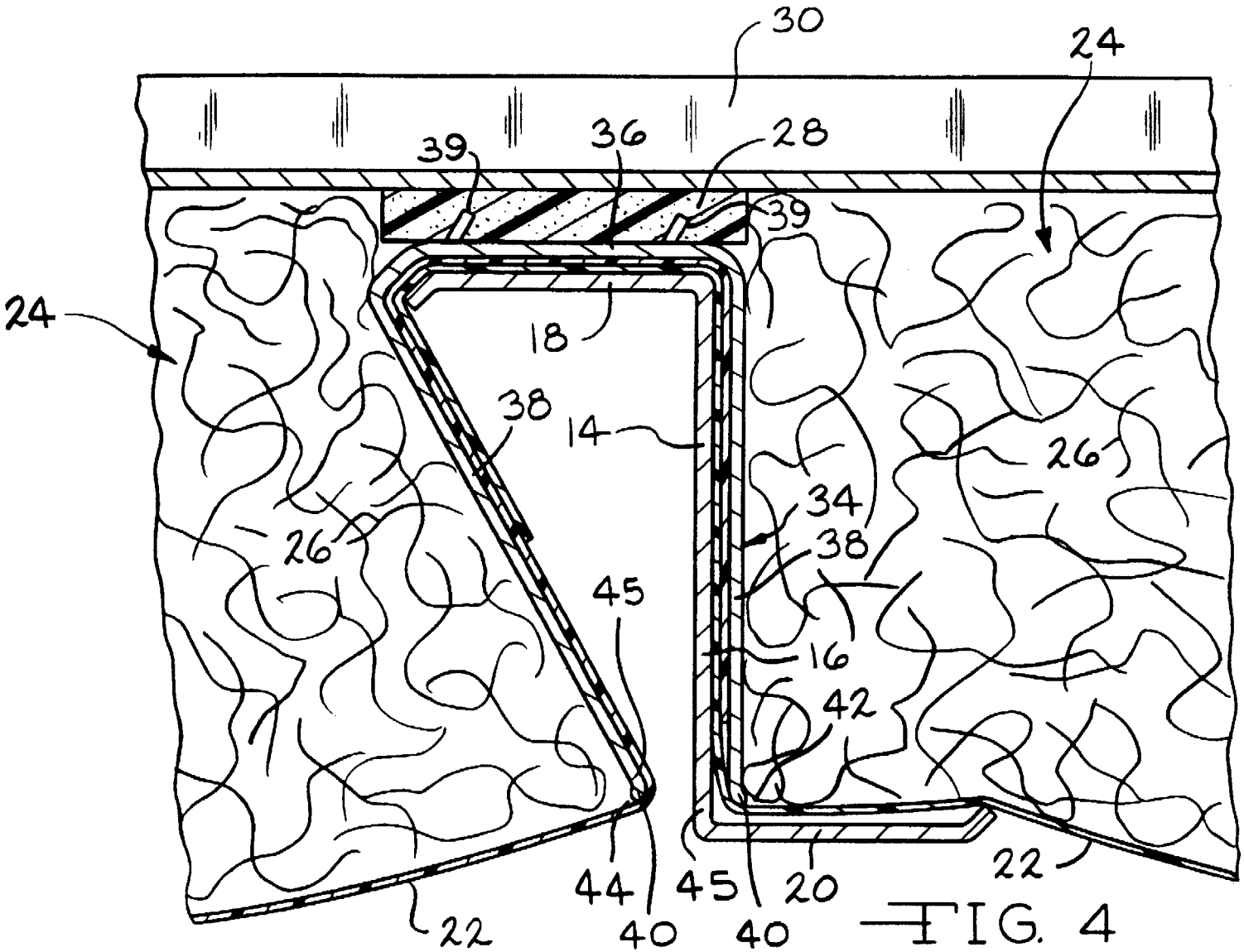
FIG. 4 is a more detailed cross-sectional view of the roof structure at a single purlin.

The roof structure 10 of the present invention, as shown in FIGS. 1, 3 and 4, utilizes a purlin cap 34 which is placed over the support sheet 22 and directly over the purlin 14 to create a larger insulating area 24. The purlin cap 34 has a horizontal top portion 36 and two generally vertical portions 38 extending downwardly from the horizontal top portion 36. The horizontal top portion 36 of the purlin cap 34 is placed on top of the horizontal top leg 18 of the purlin 14. The purlin cap 34 is preferably secured to the purlin 14 by a snap fit, but can be attached by any other means. The purlin cap can be manufactured in any suitable length. The purlin cap 34 is generally formed from sheet metal but can be manufactured from any number of materials, such as plastic or rigid foam. The horizontal top portion 36 can have an attachment structure, such as barbs 39 integrally formed in the top portion 36, to secure the foam board 28 to the roof structure.

As is seen in FIG. 4, the two vertical portions 38 of the purlin cap substantially conform to the shape of the vertical leg 16 of the purlin 14. This causes the insulation support sheet to substantially conform to the shape of the vertical leg 16 of the purlin 14. The vertical portions 38 have lower edges 40 that extend the support sheet 22 downward so that the vertical height of the sides 32 of the insulating area is maximized. The resulting shape forms corners 42 and 44 that are defined by the lower edge of the vertical portions 38 of the purlin cap 34 and the support sheet 22. The insulation material 26 extends into the corners 42 and 44, and this provides for improved insulation at the area immediately adjacent to the purlins 14.

When the vertical portions 38 of the purlin cap extend all the way down to the lower portion 45 of the purlin vertical leg 16, then the corners 42 and 44 will be located at the lower portion 45 of the purlin vertical legs. When the corner 42 is located adjacent to the purlin 14 at the intersection of the purlin vertical leg 16 and the purlin bottom leg 20, the insulating area is maximized at sides 32. This increase in insulating area thickness at the sides 32 provides for a more consistent thermal value throughout the insulating area and increases the overall R value of the roof structure. It is to be understood that the vertical portions 38 of the purlin cap 34 can be formed in a non-parallel relationship, as shown in FIG. 4, so that the widths between adjacent insulating areas 24 are not limited by the width of the horizontal top leg 18 of the purlin 14. This non-parallel arrangement allows for a greater insulating area in the corner 44 underneath the horizontal top leg 18 of the purlin 14.

Figure 5:
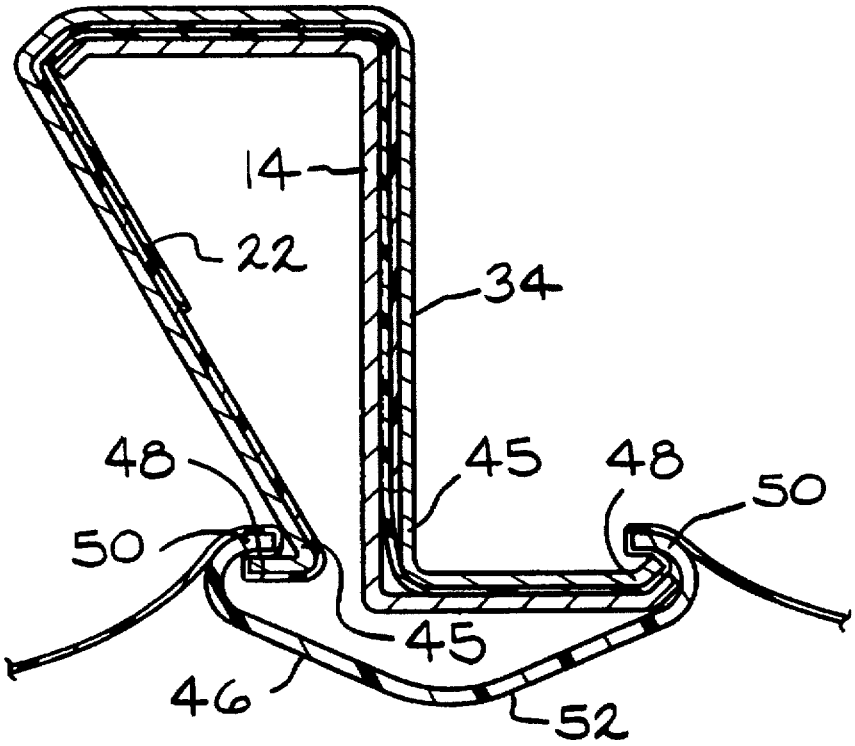
FIG. 5 is a cross-sectional view of the roof structure at a single purlin with a trim strip attached to a purlin cap.

FIG. 5 illustrates the roof structure 10 having an optional decorative trim strip 46 mounted on the purlin cap 34. The purlin cap has generally horizontal shoulders 48 extending outward from the lower portion 45 of the purlin vertical legs 16. The trim strip 46 has opposing tabs 50 that extend inward and fit over the support sheet 22 and the shoulders 48 of the purlin cap 34. A main portion 52 of the trim strip 46, which extends between the tabs 50, connects the tabs 50 to the shoulders 48 in a spring like fashion. The trim strip covers the underside portions of the purlin and purlin cap and gives an aesthetically pleasing appearance. The main portion of the trim strip can be formed to any decorative shape desired.

Figure 6:
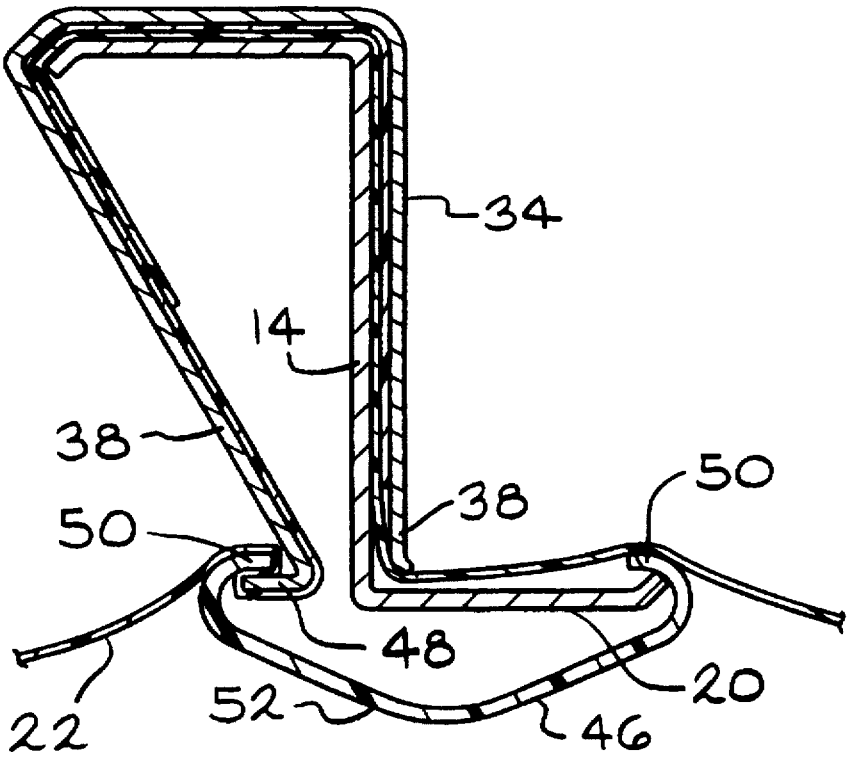
FIG. 6 is a cross-sectional view of another embodiment of the trim strip attachment.

FIG. 6 is an illustration of another embodiment of the roof structure 10 in which one of the opposing tabs 50 is mounted on a shoulder 48 of one of the vertical portions 38 of the purlin cap 34, and the other tab 50 mounted upon the horizontal bottom leg 20 of the purlin 14. The same trim strip 46 can be used for either embodiment.

Figure 7:
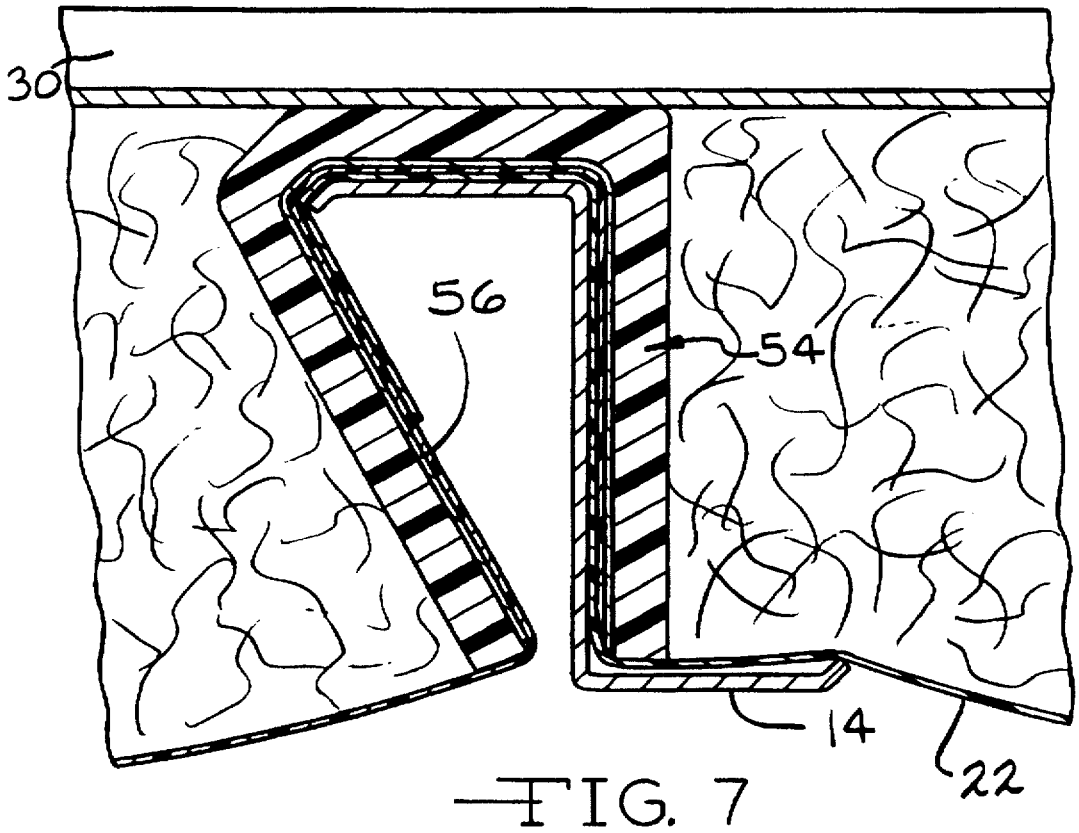
FIG. 7 is a cross-sectional view showing a purlin cap with an outer metal shell.
Figure 8:
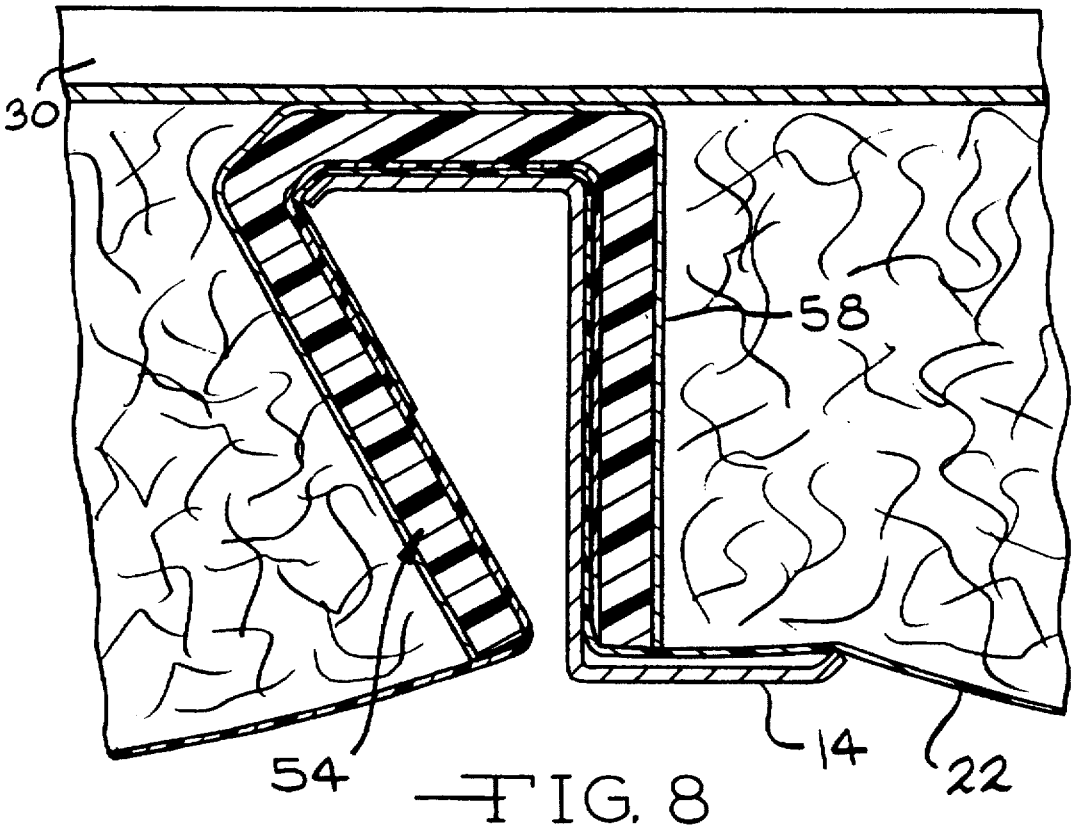
FIG. 8 is a cross-sectional view showing a purlin cap with an inner metal shell.

FIG. 7 shows an insulated purlin cap 54 of an increased thickness having an inner shell 56. The insulated purlin cap 54 can be composed of any material having good thermal insulating properties, such as a rigid foam, so that the insulation strip 28 is not necessary. While the inner shell 56 is generally formed from sheet metal, any material of sufficient rigidity may be used. FIG. 8 illustrates another embodiment of the insulated purlin cap 54 having an outer shell 58 to provide for strength. The shells 56 and 58 provide needed strength to the insulated purlin cap 54 if the material the purlin cap 54 is constructed of is unable to support the force exerted by the support sheet 22, which is weighted down by the weight of the insulation material 26. Alternatively, the insulated purlin cap 54 may be composed of an insulating material of sufficient strength so that the shells 56 and 58 are not necessary.

It will be evident from the foregoing that various modifications can be made to this invention. Such, however, are considered as being within the scope of the invention.

INDUSTRIAL APPLICABILITY

The invention can be useful in the installation of roof structures for metal buildings.

I claim:

1. A metal building roof structure, comprising:

a plurality of purlins in a parallel arrangement, each purlin having a generally vertical leg and a generally horizontal top leg;

insulation support sheets depending from the horizontal legs of adjacent purlins;

a plurality of purlin caps, each purlin cap including a generally horizontal top portion positioned on tip of the horizontal top leg of one of the purlins, two generally vertical portions extending downwardly from the horizontal top portion, and shoulders extending from the vertical portions, each purlin cap being placed over an insulation support sheet so that the vertical portions of each purlin cap cause the insulation support sheet to substantially conform to the shape of the vertical leg of a purlin; and a plurality of trim strips, each trim strip having opposing tabs mounted on said shoulders.

2. The metal building roof structure of claim 1, wherein said adjacent purlins and said insulation sheets define insulating areas, said structure further including insulation material placed into said insulating areas.

3. The metal building roof structure of claim 1, further including insulation strips applied to said horizontal top portions.

4. The metal building roof structure of claim 1, wherein the two vertical portions of each purlin cap are not parallel to each other.

5. A metal building roof structure comprising:

a plurality of purlins in a parallel arrangement, each purlin having a generally vertical leg and a generally horizontal top leg;

insulation support sheets depending from the horizontal legs of adjacent purlins;

a plurality of purlin caps, each purlin cap being formed of a foam and having a horizontal top portion positioned on top of the horizontal top leg of one of the purlins, and two generally vertical portions extending downwardly from the horizontal top portion, where the two generally vertical portions substantially conform to the shape of the vertical leg of a purlin, each purlin cap being placed over an insulation support sheet so that the vertical portions of each purlin cap cause the insulation support sheet to substantially conform to the shape of the vertical leg of a purlin, each purlin cap having shoulders extending from the vertical portions of the purlin caps; and a plurality of trim strips, each trim strip having opposing tabs which are mounted on the shoulders of the purlin caps.

6. A metal building roof structure comprising:

a plurality of purlins in a parallel arrangement, each purlin having a generally vertical leg, a generally horizontal top leg, and a horizontal bottom leg;

insulation support sheets depending from the horizontal top legs of adjacent purlins;

a plurality of purlin caps, each purlin cap being formed of a foam and having a horizontal top portion positioned on top of the horizontal top leg of one of the purlins, and two generally vertical portions extending downwardly from the horizontal top portion, where the two generally vertical portions substantially conform to the shape of the vertical leg of a purlin, each purlin cap being placed over an insulation support sheet so that the vertical portions of each purlin cap cause the insulation support sheet to substantially conform to the shape of the vertical leg of a purlin, each purlin cap having a shoulder extending from a vertical portion of a purlin cap; and a plurality of trim strips, each trim strip having opposing tabs, one of the tabs mounted on the shoulder of a purlin cap, and the other tab mounted on the horizontal bottom leg of a purlin.

7. A method of insulating a metal building roof structure having a plurality of purlins in a parallel arrangement, each purlin having a generally vertical leg and a generally horizontal top leg, comprising:

positioning insulation support sheets so that they depend from the horizontal top legs of adjacent purlins;

applying a plurality of purlin caps, each purlin cap having a horizontal top portion positioned on top of the horizontal leg of one of the purlins, two generally vertical portions extending downwardly from the horizontal top portion over the insulation support sheets so that the two vertical portions of each purlin cap cause the insulation sheets to substantially conform to the shape of the vertical leg of the purlin, and shoulders extending from the vertical portions of the purlin cap; and mounting trim strips having opposing tabs on the shoulders of the purlin caps.

8. The method of insulating a roof structure of claim 7 further comprising applying insulation strips to the horizontal top portions of the purlin caps.

9. The method of insulating a roof structure of claim 7 in which the purlins have horizontal bottom legs and in which the purlin caps have a shoulder extending from vertical portions of the purlin caps, and further comprising mounting trim strips having opposing tabs on the shoulders of the purlin caps and the bottom legs of the purlins.

UNITED STATES PATENT AND TRADEMARK OFFICE

CERTIFICATE OF CORRECTION

PATENT NO. : 5,724,780

DATED : March 10, 1998

INVENTOR(S) : Richard M. Bolich

It is certified that error appears in the above-identified patent and that said Letters Patent is hereby corrected as shown below:

In claim 1, line 31 should read:

generally horizontal top portion positioned on top of the. . .

Signed and Sealed this

Twenty-fourth Day of November,1998

*Attest:*

Bruce Lehman

BRUCE LEHMAN

*Attesting Officer*

*Commissioner of Patents and Trademarks*